United States Patent [19]

Müller et al.

[11] Patent Number: 4,573,624

[45] Date of Patent: Mar. 4, 1986

[54] PORTABLE ELECTRIC STAPLER

[75] Inventors: Erwin Müller; Czeslaw Zakrzewski; Burghard Matzdorf, all of Lingen, Fed. Rep. of Germany

[73] Assignee: Erwin Müller GmbH & Co., Lingen, Fed. Rep. of Germany

[21] Appl. No.: 707,667

[22] Filed: Mar. 4, 1985

Related U.S. Application Data

[62] Division of Ser. No. 527,314, Aug. 29, 1983, abandoned.

[30] Foreign Application Priority Data

Aug. 28, 1982 [DE] Fed. Rep. of Germany ..... 3232137

[51] Int. Cl.[4] ..... B25C 5/15

[52] U.S. Cl. ..... 227/121; 227/8; 227/131

[58] Field of Search ..... 227/8, 121, 131; 29/432

[56] References Cited

U.S. PATENT DOCUMENTS 3,141,171 7/1964 Doyle et al. ..... 227/8 X
4,183,453 1/1980 Barrett et al. ..... 227/131

FOREIGN PATENT DOCUMENTS 0057896 8/1982 European Pat. Off. ..... 227/131
2729002 1/1979 Fed. Rep. of Germany ..... 227/131
2059852 4/1981 United Kingdom ..... 227/131

*Primary Examiner*—Howard N. Goldberg
*Assistant Examiner*—John T. Burtch
*Attorney, Agent, or Firm*—Peter K. Kontler

[57] ABSTRACT

A portable electric stapler wherein a bladelike impeller is reciprocable by the armature of an electromagnet which is energizable a selected number of times so that a staple which is introduced into a housing channel in front of the impeller is gradually driven into a workpiece. The magazine for staples and that part of the housing which defines the channel are movable relative to the impeller between a first position in which a pusher can expel a staple from the magazine into the channel and a second position whereby the impeller separates the foremost staple from the stack of coherent staples in the magazine. The impeller blocks the outlet of the magazine during the intervals between successive energizations of the electromagnet to thus prevent entry of a fresh staple into the channel before the driving of the preceding staple into the workpiece is completed. The rearward movements of the armature and the impeller are braked by a pneumatic brake or by a shock absorber. The electronic control circuit of the stapler can be adjusted to select the number of successive energizations of the electromagnet.

18 Claims, 14 Drawing Figures

PORTABLE ELECTRIC STAPLER

This application is a division, of application Ser. No. 527,314, filed Aug. 29, 1983, now abandoned.

BACKGROUND OF THE INVENTION

The present invention relates to improvements in portable impact tools in general, and more particularly to improvements in portable apparatus which can be used with particular advantage for driving nails, U-shaped staples or analogous fasteners into pieces of wood, concrete; plastic or the like.

It is already known to employ an electromagnet as a means for applying forces to a reciprocable impeller which serves to drive successive nails, staples or like fasteners into pieces of wood or the like. It is also known to impart to the impeller the shape of a blade and to secure such impeller directly to the reciprocable armature of an electromagnet. When the impeller is retracted, the apparatus allows or causes a fresh fastener to advance in front of the retracted impeller, and the latter thereupon receives an impulse to perform a forward stroke which results in expulsion of the freshly admitted fastener from the apparatus and into the material of a workpiece.

It is further known to regulate the magnitude of impacts which the impeller transmits to a fastener by energizing the electromagnet with several full waves or half waves of electric current. It is equally known to regulate the forces which are transmitted by an electric impact stapler or the like in accordance with the so-called phase operating angle principle.

A drawback of presently known apparatus of the above outlined character is that a mere regulation of the magnitude or intensity of an impact does not always suffice to ensure optimum introduction of a fastener into a workpiece. Moreover, conventional proposals are unsatisfactory on the additional ground that the energy consumption is very high and that the apparatus must be designed to receive or generate large currents in order to be in a position to regulate the magnitude of impacts within a desired range. The application of large currents necessitates appropriate measures to avoid overloading of the network. Still further, when the fasteners must be driven home in response to the application of large forces, the parts of the apparatus are subjected to very pronounced stresses so that the useful life of such apparatus is short and/or the apparatus require frequent inspection, maintenance and repair.

In many instances, the introduction of a nail, staple or the like into a workpiece in response to the application of a single impulse to an impeller which is used to drive the fastener home is highly undesirable and unsatisfactory because the abruptly introduced fastener is likely to damage the surface of the workpiece around the locus of introduction or in response to bending as a result of the application of a very pronounced impact. Furthermore, a tool which can generate and abruptly apply very large forces is dangerous since it can be used as a gun which is capable of propelling a projectile through a considerable distance and in such a way that the projectile can cause serious injuries or death at a locus which is remote from the apparatus.

OBJECTS AND SUMMARY OF THE INVENTION

An object of the invention is to provide an apparatus for driving home staples, nails or analogous fasteners in a novel and improved way so that the workpiece which is to receive the fastener or fasteners is less likely to be damaged or defaced than conventional apparatus.

Another object of the invention is to construct and assemble the apparatus in such a way that it can reliably drive home any one of of a wide variety of fasteners even though such fasteners need not be propelled with a great force.

A further object of the invention is to provide an apparatus which can be readily adjusted to drive home any one of several types of fasteners with a force which is best suited for optimum penetration of fasteners into a selected workpiece.

An additional object of the invention is to provide an apparatus which can be used with advantage for introduction of large or small fasteners into relatively soft as well as into dense and very dense materials.

A further object of the invention is to provide a relatively simple and compact apparatus which can be operated by skilled, semiskilled or even unskilled persons with a minimum of training and which can be used for introduction of fasteners into upper sides, undersides or other sides of workpieces consisting of any one of a large number of different materials including wood, plastics and metals.

Still another object of the invention is to provide an apparatus which can be rapidly converted from the introduction of fasteners into a relatively soft material to the introduction of fasteners into a much denser material or vice versa.

The invention resides in the provision of an apparatus for driving nails, staples or analogous fasteners into workpieces. The apparatus comprises a housing having a portion defining a path (e.g., in the form of a channel) along which successive fasteners can be advanced in a predetermined direction to penetrate into a selected workpiece, a magazine or another suitable source of supply arranged to store a series of preferably coherent but separable fasteners and having outlet means communicating with the path, a spring-biased pusher or other suitable means for urging successive fasteners of the series through the outlet means and into the path, a reciprocable impeller which is disposed in the path and normally assumes a predetermined starting or retracted position behind the outlet means (as considered in the aforementioned direction), an electromagnet which is operatively connected with the impeller and is energizable at predetermined intervals to propel the impeller in the aforementioned direction with reference to the outlet means so that a fastener in the path is advanced toward a workpiece which is disposed in front of the path whenever the electromagnet is energized, and means for moving the impeller counter to the aforementioned direction during each of the intervals between successive energizations of the electromagnet and through distances such that the impeller blocks the outlet means and thus prevents advancement of a fresh fastener from the magazine into the path. The apparatus further comprises control means for selecting the number of successive automatic energizations of the electromagnet at selected intervals. The control means can comprise an electronic circuit having means which is arranged to select up to at least eight successive energizations of the electromagnet, and such circuit can comprise a pair of synchronized decimal counters whose outputs serve to furnish energizing impulses to the winding of the electromagnet, a switch or other suitable means for selecting the number of energizing impulses, a flip-flop circuit which is connected with the outlets of the decimal counters, and an output thyristor which is interposed between the flip-flop circuit and the winding.

The outlet means of the magazine is preferably movable with reference to the impeller, and the apparatus then further comprises means for yielding opposing the movement of the outlet means of the magazine from a first position in which the foremost fastener of a series of coherent fasteners in the magazine is free to enter the path in the starting position of the impeller to a second position whereby the fastener in the path moves against the impeller while the impeller continues to assume its starting position so that the impeller automatically separates such fastener from the neighboring fastener of the series. The outlet means of the magazine can be moved with reference to the impeller in a number of ways. For example, that portion of the magazine which is remote from the outlet means can be pivotally connected to the housing and the opposing means can comprise a spring which tends to pivot the magazine in a given direction. Alternatively, the magazine can be mounted for reciprocatory movement in substantial parallelism with the direction of advancement of fasteners along the path. The opposing means (such as the aforementioned spring) is preferably constructed and mounted to apply to the magazine a force which is a predetermined fraction of the force serving to move the impeller in the aforementioned direction in response to each energization of the electromagnet.

The means for energizing the electromagnet for the first time or the only time (depending on the setting of the aforementioned means for selecting the number of impulses) can be designed to effect such energization in response to completion of movement of the outlet means to the second position, i.e., subsequent to separation of the fastener in the path from the neighboring fastener of the series of fasteners in the magazine.

The moving means can comprise means (e.g., a suitable spring acting upon the armature of the electromagnet) for accelerating the impeller counter to the aforementioned direction and means for braking the thus accelerated impeller to bring the impeller to a halt before it exposes the outlet means. The braking means can comprise a pneumatic braking device, and such braking device can comprise a cylinder which is mounted in or on the housing, a piston which is provided on or is movable by the armature of the electromagnet and is reciprocable in the cylinder, and a check valve which is designed to open in response to movement of the piston in the cylinder in response to energization of the electromagnet. The cylinder can be provided with at least one air-admitting port and the check valve can comprise an elastic valving element which seals the port when the armature moves the piston counter to the aforementioned direction and to expose the port for admission of air into the cylinder when the piston moves in the aforementioned direction to thereby reduce the pressure in the cylinder. The cylinder is further provided with aerating openings which serve to permit escape of air from its interior at a controlled rate in response to movement of the piston counter to the aforementioned direction. To this end, the combined cross-sectional area of openings in successive portions of the cylinder decreases, as considered counter to the aforementioned direction, i.e., the mass of air which remains in the cylinder offers a progressively increasing resistance to movement of the impeller counter to the aforementioned direction and ultimately brings the impeller to a halt before the latter reaches its starting position.

Alternatively, the braking means can comprise a shock absorber.

Still further, the braking means can be employed jointly with or replaced by an arresting device for arresting the accelerated impeller at a predetermined distance from the outlet means while it continues to block the outlet means and thus prevents entry of fresh fasteners from the magazine into the path which is or can be defined by the housing. The arresting means can comprise an abutment or another suitable stop which is movable into and from the path of movement of the impeller counter to the aforementioned direction, e.g., by a discrete second electromagnet or by other suitable electrically operated means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 14:
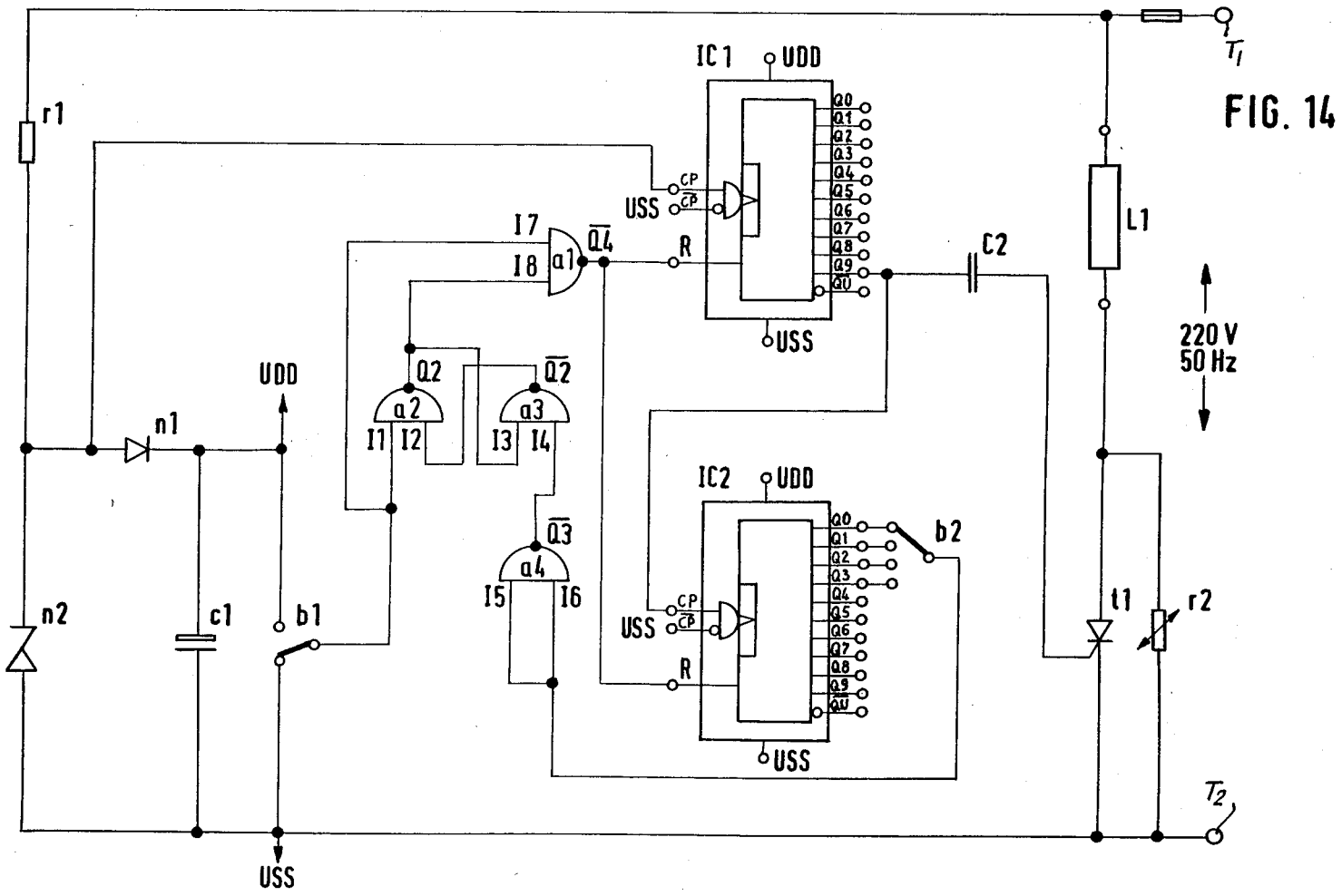
FIG. 14 is a circuit diagram of the electronic control circuit of the apparatus which embodies the present invention.

The apparatus 1 which is shown in the drawing comprises a housing 2 including a handle 3 connected with one end of a cable 5 the other end of which is connected with a suitable source of electrical energy (see the terminals T1 and T2 in FIG. 14). The housing 2 includes a head portion or top portion 4 at a level above an impeller here shown as an elongated thin blade 7 serving to propel successive fasteners 22 (namely, U-shaped staples), which are supplied by a magazine 13, in response to energization of an electromagnet whose armature is shown at 6 (see FIG. 7). The ends of conductors 5*a*, 5*b* in the cable 5 are connected to a master switch 8 which is confined in the interior of the housing 2. A trigger 9 is accessible to a finger of the hand holding the handle 3 to initiate energization of the electromagnet and expulsion of a staple 22 from a narrow channel 21 constituting a portion of an elongated path defined by that portion of the housing 2 which is adjacent to and is located in front of the magazine 13. In the illustrated embodiments, the channel 21 is defined by a portion of the housing 2 which is rigid with the adjacent front portion of the magazine 13. The reference character 10 denotes the winding of the electromagnet in the housing 2, and the character 11 denotes an electronic control circuit including impulse generator means and installed in the handle 3 behind the master switch 8. The handle 3 further carries a selector switch 12 forming part of the control circuit 11 and serving to allow for selection of a desired number of impulses.

Figure 7:
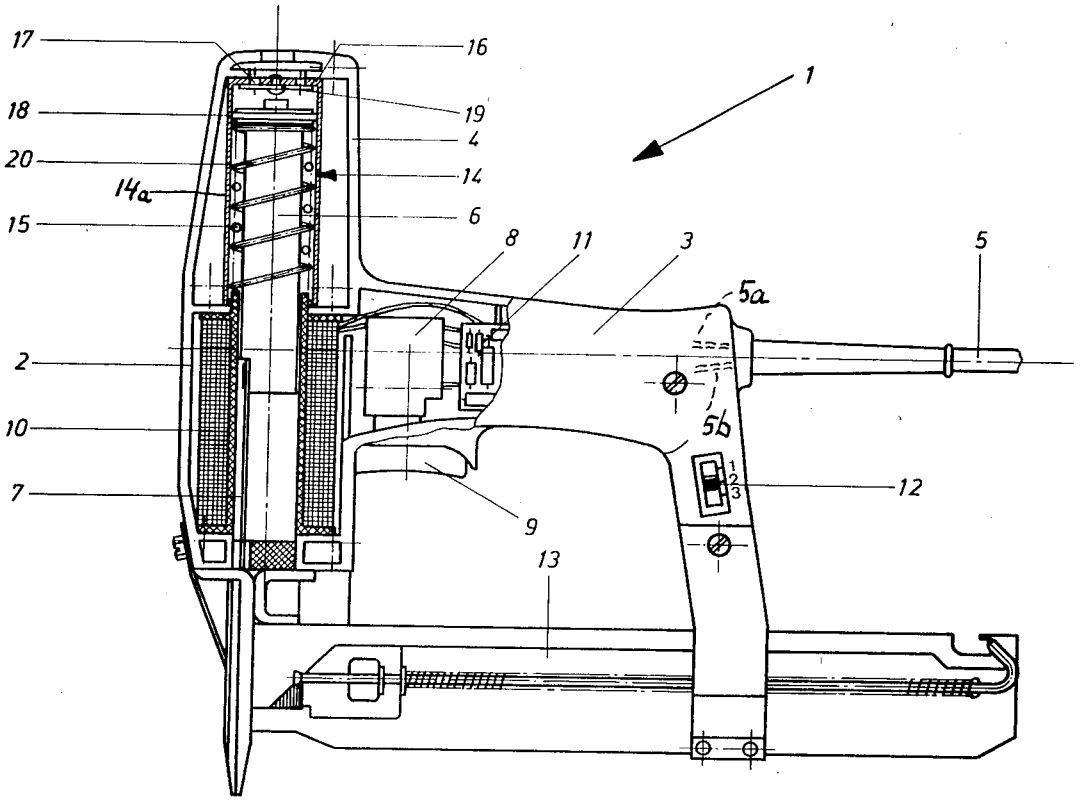
FIG. 7 is a somewhat schematic partly elevational and partly sectional view of a slightly modified apparatus with a braking mechanism for the armature of the electromagnet which moves the impeller with reference to the housing.
Figure 11:
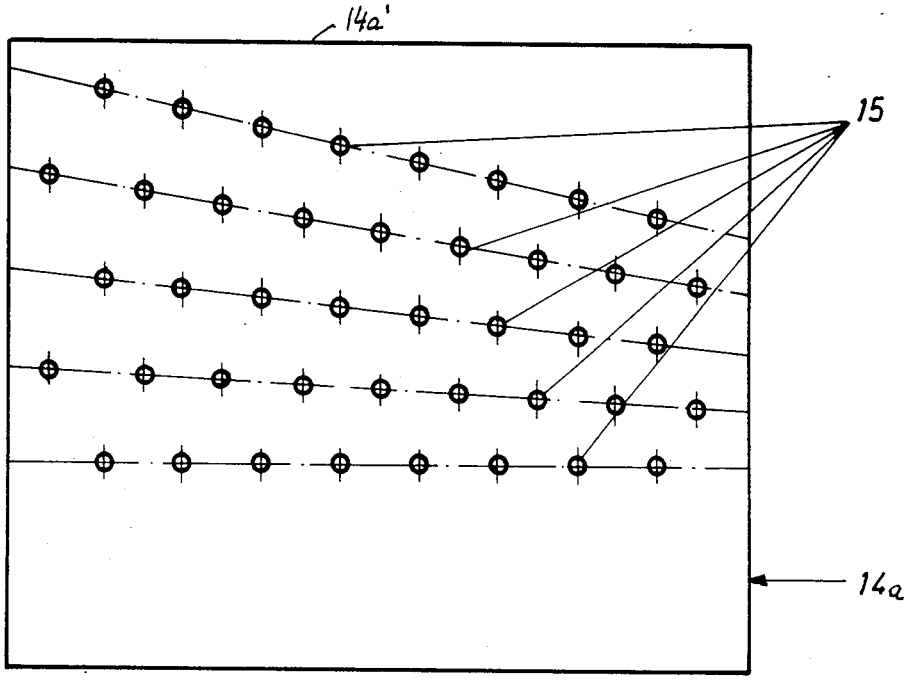
FIG. 11 is a developed view of the cylinder which is used in the braking device of the apparatus shown in FIGS. 7 to 10.

The top portion 4 of the housing 2 accommodates a pneumatic braking unit 14 whose cylinder 14*a* has a top wall 16 and is further provided with aerating openings 15 (see FIGS. 7 and 11). Ports 17 in the top wall 16 can be sealed by an elastically deformable disc-shaped valving element 19 which is installed in the interior of the cylinder 14*a* and allows only for the inflow of air, i.e., the top wall 16 and the valve elenent 19 can be said to constitute a check valve for admission of air into the cylinder 14*a*. The upper end portion of the armature 6 constitutes a piston which is surrounded by a sealing ring 18 and is reciprocable in the cylinder 14*a*. A coil spring 20 in the top portion 4 of the housing 2 tends to maintain the armature 6 in an upper end position, and such spring stores additional energy whenever the coil 10 is energized to propel the armature 6 downwardly so as to cause the blade 7 to expel a staple 22 through the channel 21 and into a workpiece 25 therebelow.

Figure 4:
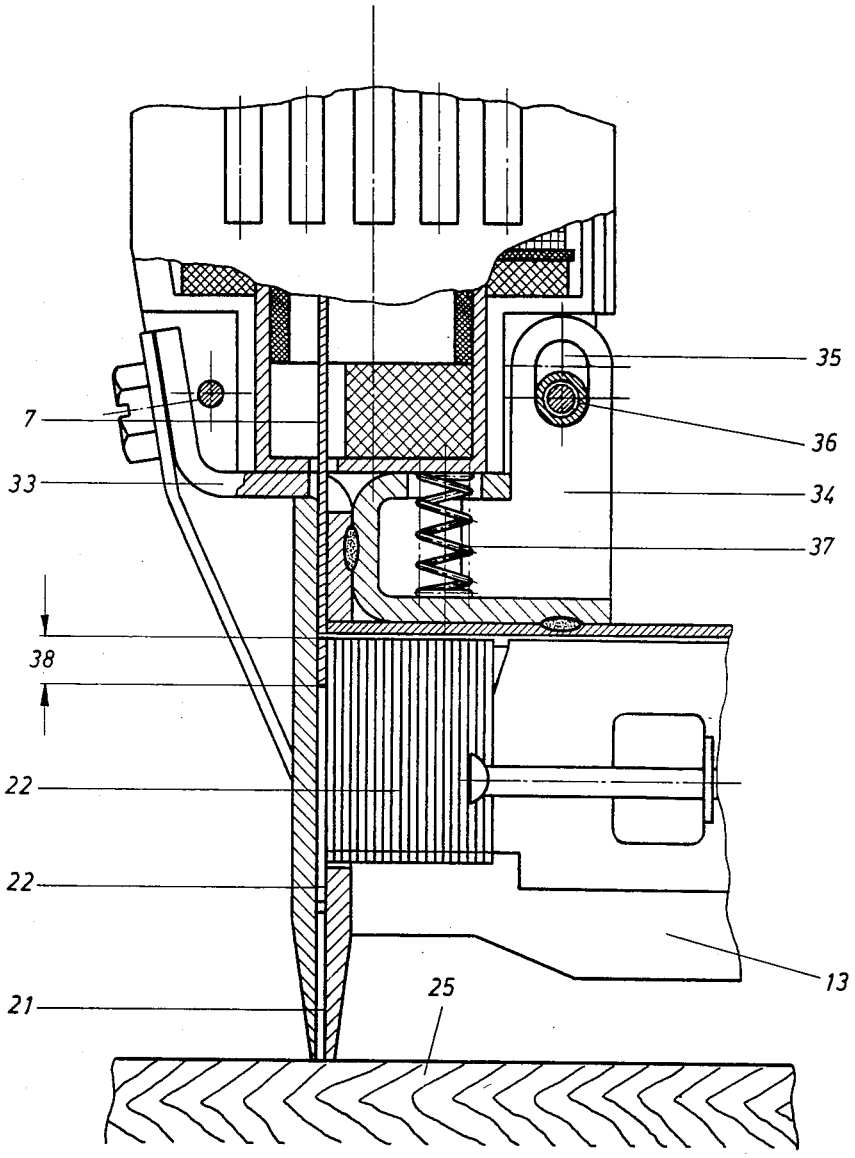
FIG. 4 illustrates the structure of FIG. 2 but with the channel-defining portion of the housing abutting against a workpiece and with the magazine shown in a position it assumes during introduction of a fastener into the workpiece.

The apparatus 1 further comprises a pusher 23 which is reciprocable in the magazine 13 under the action or against the opposition of a prestressed coil spring 24 which causes the file of aligned staples 22 to move forwardly so that the foremost staple 22 automatically advances through the outlet 13*a* of the magazine 13 and enters the channel 21 as soon as the blade 7 is retracted to a level above the file of coherent staples in the magazine 13 or as soon as the magazine is raised to the position which is shown in FIG. 4.

The electronic control circuit 11 of the apparatus 1 is shown in FIG. 14. This circuit comprises a series resistor r1 in series with a Zener diode n2. The tap between the diode n2 and the resistor r1 is connected with a second diode n1, and the diode n2 is connected in parallel with an electrolytic capacitor c1. The conductors USS and UDD connect the parts of the circuit with the terminals T2, T1 of the aforementioned source of electrical energy, e.g., an a-c source of 220 V, 50 Hz potential. The switch b1 of FIG. 14 is an equivalent of the master switch 8 shown in FIG. 7, and the switch b2 corresponds to the switch 12 of FIG. 7. The control circuit of FIG. 14 further comprises a first synchronous decimal counter IC1 with timing inputs CP, a resetting input R and decimal counter outputs Q0, Q1, . . . Q0, a first NAND gate a1, a bistable flip-flop circuit a2, a3, a second NAND gate a4, a second capacitor c2, an output thyristor t1, a varistor r2, a winding L1 corresponding to the winding 10, and a second synchronized decimal counter IC2.

The just outlined electronic circuit 11 is assembled of prefabricated modules and is designed to generate one or more firing impulses (e.g., up to at least eight impulses) at the intervals of 20 milliseconds, i.e., according to the duration of one cycle of the power supply. The sequence is adjustable between 20 and 180 ms. The series resistor r1, the diode n1, the Zener diode n2 and the electrolytic capacitor c1 supply the voltage USS, UDD. The Zener diode n2 causes the generation of a square impulse at the network frequency which is applied to the corresponding timing input CP of the synchronized decimal counter IC1. The decimal counter IC1 remains passive as long as the directly acting reset input R receives a logic "H" signal (condition of idleness). The decimal counter IC1 is activated when the two inputs 17 and 18 of the NAND gate a1 receive a logic "H" signal.

When the counter IC1 is idle, the output Q2 of the bistable RS-flip-flop circuit a2, a3 transmits a logic "H" signal. By actuating the switch b1 (corresponding to the switch 8 of FIG. 7), the operator applies an "H" signal to the input 17 of the NAND gate a1. Consequently, and in view of the selected modular design of the circuit of FIG. 14, the output $\overline{Q4}$ of the NAND gate a1 transmits a logic signal "L" and the resetting input R of the counter IC1 receives a logic "L" signal.

The impulse at the output Q9 of the counter IC1 is the firing impulse for the thyristor t1 (via capacitor c2).

The switch b2 of FIG. 14 (corresponding to the selector switch 12 of FIG. 14) serves for selection of the output Q0, Q1, Q2 or Q3 of the second synchronous decimal counter IC2. In dependency on the position of the movable contact of the switch b2, the RS flip-flop circuit a2, a3 receives a resetting impulse from the decimal counter IC2 after one, two, three or four firing impulses by way of the switch b2 and NAND gate a4.

In other words, the output Q2 of the flip-flop circuit transmits an "L" signal. Consequently, the output $\overline{Q4}$ of the first NAND gate a1 and the resetting inputs R of the decimal counters IC1 and IC2 each transmit an "H" signal. This terminates the transmission of output signals or firing impulses. A further cycle begins only in response to renewed actuation of the switch b2 (corresponding to the switch 12 of FIGS. 1 and 7).

Figure 5:
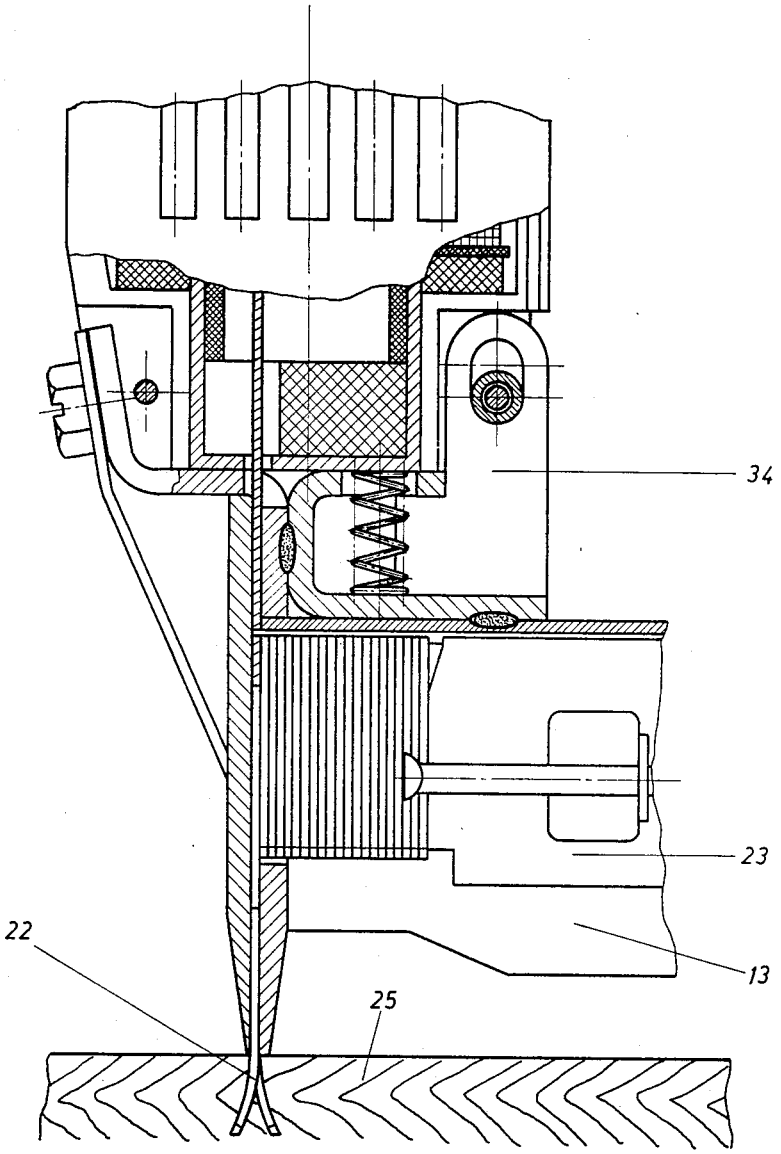
FIG. 5 shows the structure of FIG. 4, with the fastener partly introduced into the workpiece.

The operation of the apparatus which is shown in FIGS. 1 to 11 is as follows:

In the first step, the discharge end of the channel 21 is placed against the adjacent surface of the workpiece 25 in a manner as shown in FIGS. 4 and 5. The person grasping the handle 3 exerts pressure in a direction toward the workpiece 25 so that the magazine 13 and the lower portion of the housing 2 are displaced against the opposition of a coil spring 37 while a follower plate 34 which is rigid with the magazine 13 slides relative to a guide pin 36 on the housing 2. The guide pin 36 extends into an elongated slot 35 of the plate 34. The stroke of the magazine 13 in response to displacement of the follower plate 34 with reference to the guide pin 36 is indicated at 38 (note FIG. 1). The character 32 denotes the front panel of that portion of the housing 2 which defines the channel 21, and the character 33 designates a reciprocable carrier for the front panel 32. The carrier 33 moves with the follower plate 34 from the first position of FIG. 1 to the second position which is shown in FIGS. 4 and 5 while the spring 37 undergoes deformation in response to the application of manual pressure against the handle 3 to move nearer to the workpiece 25. The length of the aforementioned stroke 38 is determined by the length of the slot 35 in the follower plate 34.

As the handle 3 descends toward the workpiece 25, the lower end of the blade 7 (which is held in the starting or retracted position of FIGS. 1–4) penetrates into the channel 21 and automatically separates the foremost staple 22 from the file of staples in the magazine 13. Actually, the outlet 13*a* of the magazine 13 moves upwardly relative to the blade 7. As is customary, the staples 22 in the magazine 13 form a series of separably connected fasteners which can be readily separated from each other in response to the application of a force of a magnitude that can be readily achieved by pushing the handle 3 downwardly against the opposition of the spring 37. The thus separated foremost staple 22 is shifted in the channel 21 through a distance corresponding to the stroke 38, i.e., such foremost staple is shifted with respect to the next-following staple which continues to form part of a series of coherent staples in the magazine 13. The blade 7 then blocks the outlet 13*a* of the magazine 13.

Figure 2:
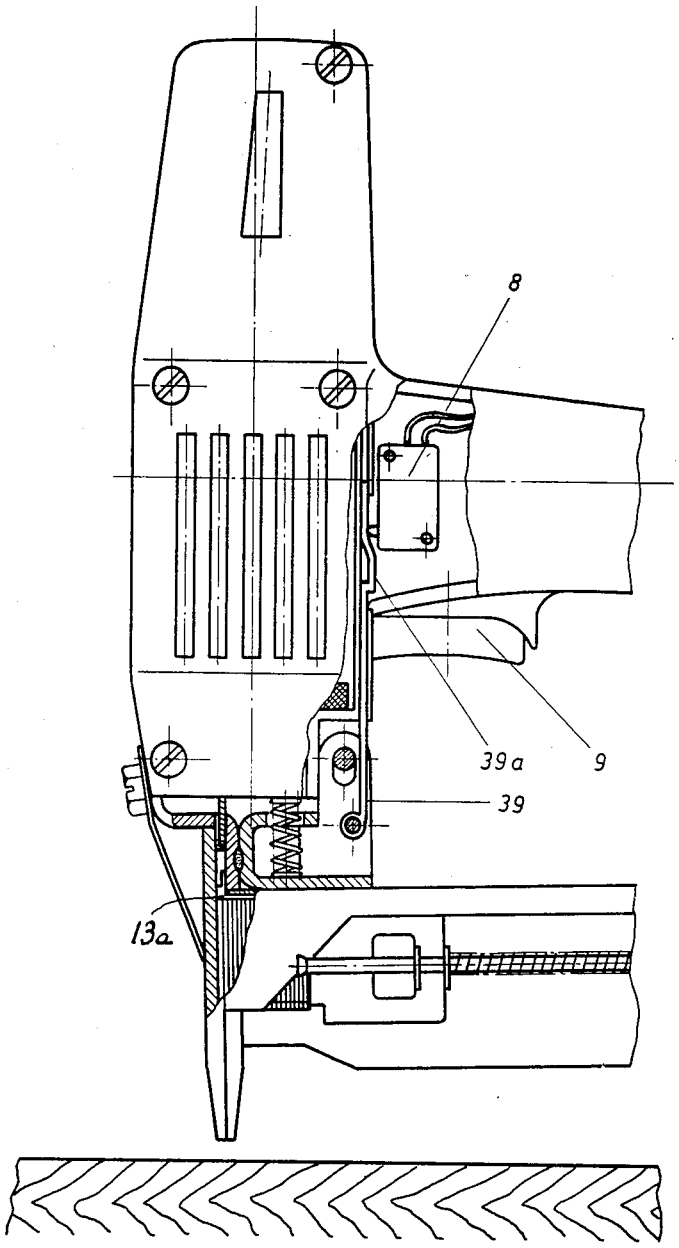
FIG. 2 is an enlarged view of the left-hand portion of the apparatus which is shown in FIG. 1, an additional portion of the housing being broken away to expose a switch which can be actuated by a pivotable trigger at the underside of a handle on the housing.

Depression of the handle 3 against the opposition of the spring 37 further results in displacement of a release lever 39 from the starting or idle position of FIG. 2. The lever 39 is articulately connected to the guide plate 34 and its idle and operative positions are respectively shown in FIGS. 2 and 6. When the lever 39 assumes the operative position of FIG. 6, the apparatus 1 is ready for use because the trip 39*a* of this lever has actuated the master switch 8. The finger of the operator depresses the trigger 9 to energize the winding 10 of the electromagnet in the desired manner, namely, in a manner which depends upon the setting of the selector switch 12 which latter determines the number of impulses applied to the blade 7. The blade 7 drives the foremost staple 22 (in the channel 21) into the workpiece 25. FIG. 5 shows the blade 7 in the raised or starting position, i.e., at the rear or upper end of its single stroke or one of several strokes.

In the ilustrated embodiment, the magazine 13 is designed to accommodate U-shaped staples 22. However, it is equally within the purview of the invention to design the magazine 13 or an analogous magazine for storage of nails or other types of fasteners.

Figure 9:
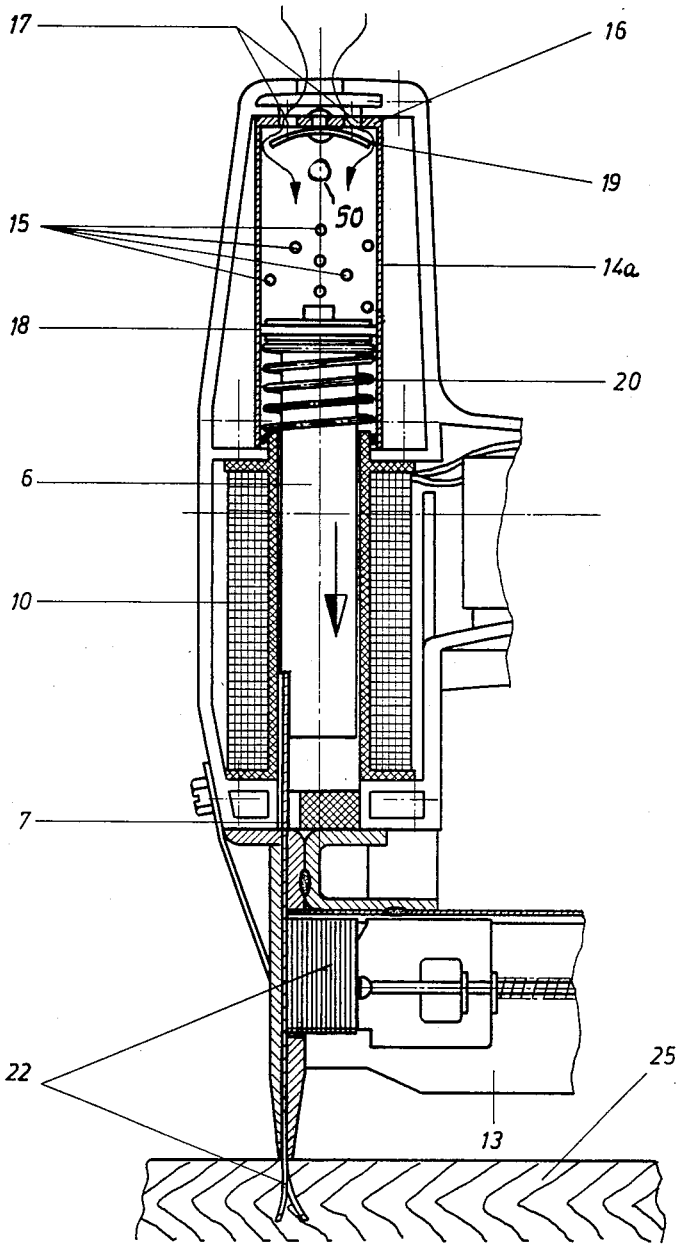
FIG. 9 shows the structure of FIG. 8, with the housing abutting against a workpiece and with the impeller in the process of driving a fastener into the workpiece.
Figure 10:
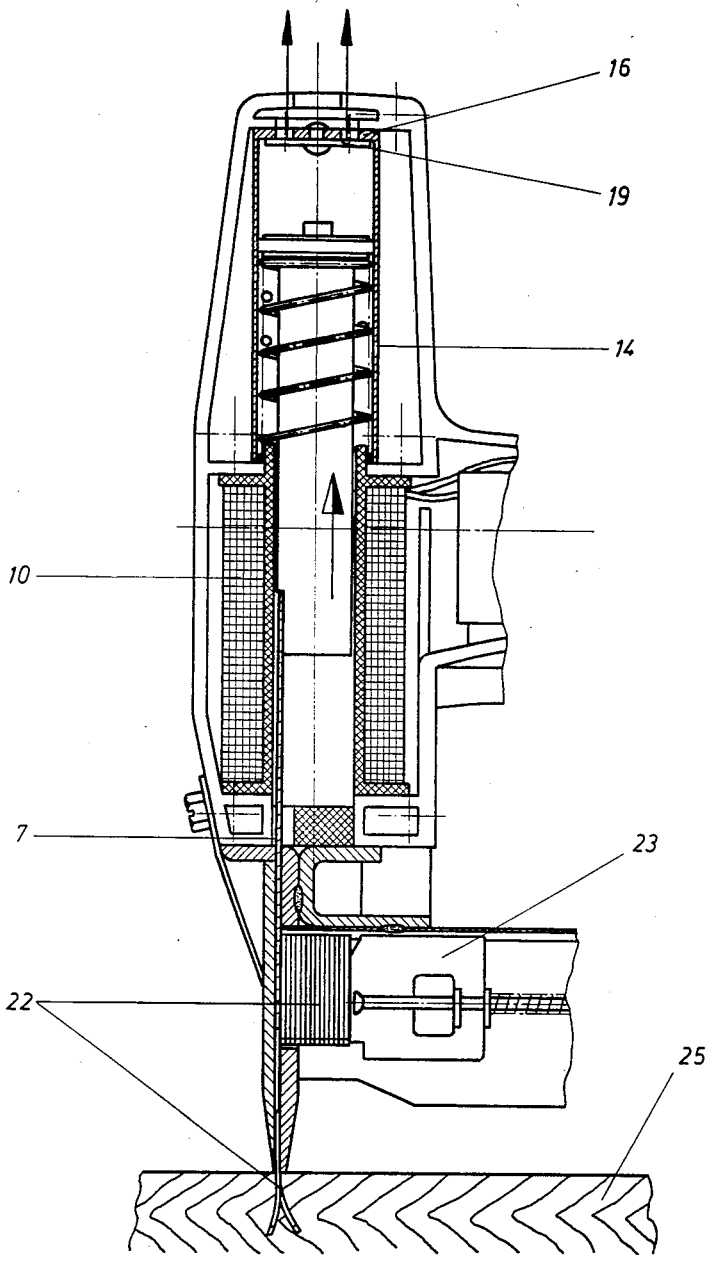
FIG. 10 illustrates the structure of FIG. 9 but with the armature of the electromagnet in a different position in which the impeller continues to prevent penetration of the foremost fastener from the magazine into the channel of the apparatus.

When the blade 7 completes the the selected number of working strokes, the staple 22 which was confined in the channel 21 is driven fully into the workpiece 25. FIGS. 9 and 10 illustrate those two stages of driving a staple 22 into the workpiece 25 which precede the last stage. Once the staple 22 is fully introduced into the workpiece 25, the apparatus 1 can be lifted off the workpiece so that the spring 37 is free to dissipate some energy and to return the magazine 13 to its lower end position whereby the blade 7 is fully retracted from the channel 21. This enables the pusher 23 to advance the foremost staple 22 of the file of staples in the magazine 13 into the channel 21 at a level below the lower edge of the blade 7. It will be noted that, while a staple 22 is being driven into a selected workpiece (such as the illustrated workpiece (such as the illustrated workpiece 25), the blade 7 acts as a means for preventing the penetration of the foremost staple 22 from the magazine 13 into the channel 21, i.e., the blade 7 blocks the outlet 13*a*.

The pneumatic braking device of the type shown in FIG. 7 does not interfere with forward movements of the blade 7 in a direction to drive the staple 22 which is confined in the channel 21 toward and into the workpiece 25 located below or adjacent to the discharge end of the channel. When a firing impulse is terminated in the aforedescribed manner, the armature 6 terminates its downward movement (namely, its movement toward the discharge end of the channel 21) in any one of several possible positions one of which is shown in FIG. 9. While the armature 6 moves toward the channel 21, the ports 17 in the top wall 16 of the cylinder 14*a* admit air into the interior of the cylinder 14*a* whereby the inflowing air streams flex the valving element 19 in a manner as shown in FIG. 9 and allow the inflowing air to fill the space above the piston-like upper end portion of the armature 6. The valving element 19 is flexed in the manner as shown in FIG. 9 because the pressure in the cylinder 14*a* drops below atmospheric pressure when the armature 6 moves the sealing ring 18 away from the top wall 16.

When the energization of the winding 10 of the electromagnet in the housing 2 is completed, the spring 20 is free to urge the armature 6 upwardly so that the sealing ring 18 advances toward the top wall 16 of the cylinder 14*a*. Air which is confined in the cylinder 14*a* at a level above the armature 6 is permitted to escape through the aerating openings 15 so that the armature 6 encounters a gradually increasing resistance to return movement toward the retracted position of FIG. 7 or 8. As the sealing ring 18 approaches the top wall 16 of the cylinder 14*a*, the number of aerating openings 15 which are available to permit escape of air from the space at a level above the ring 18 decreases (see FIGS. 9 and 11) and, therefore, the entrapped air acts not unlike an elastic cushion which brakes and decelerates the return movement of the upwardly accelerated armature 6 to its retracted position. The valving element 19 seals the ports 17 in the top wall 16 as soon as the pressure in the interior of the cylinder 14*a* at a level above the sealing ring 18 rises, i.e., as soon as the armature 6 begins to move in the direction which is dictated by the coil spring 20. The armature 6 comes to a halt as soon as the sealing ring 18 rises to a level above the topmost aerating opening 15 in the cylinder 14*a*.

Figure 1:
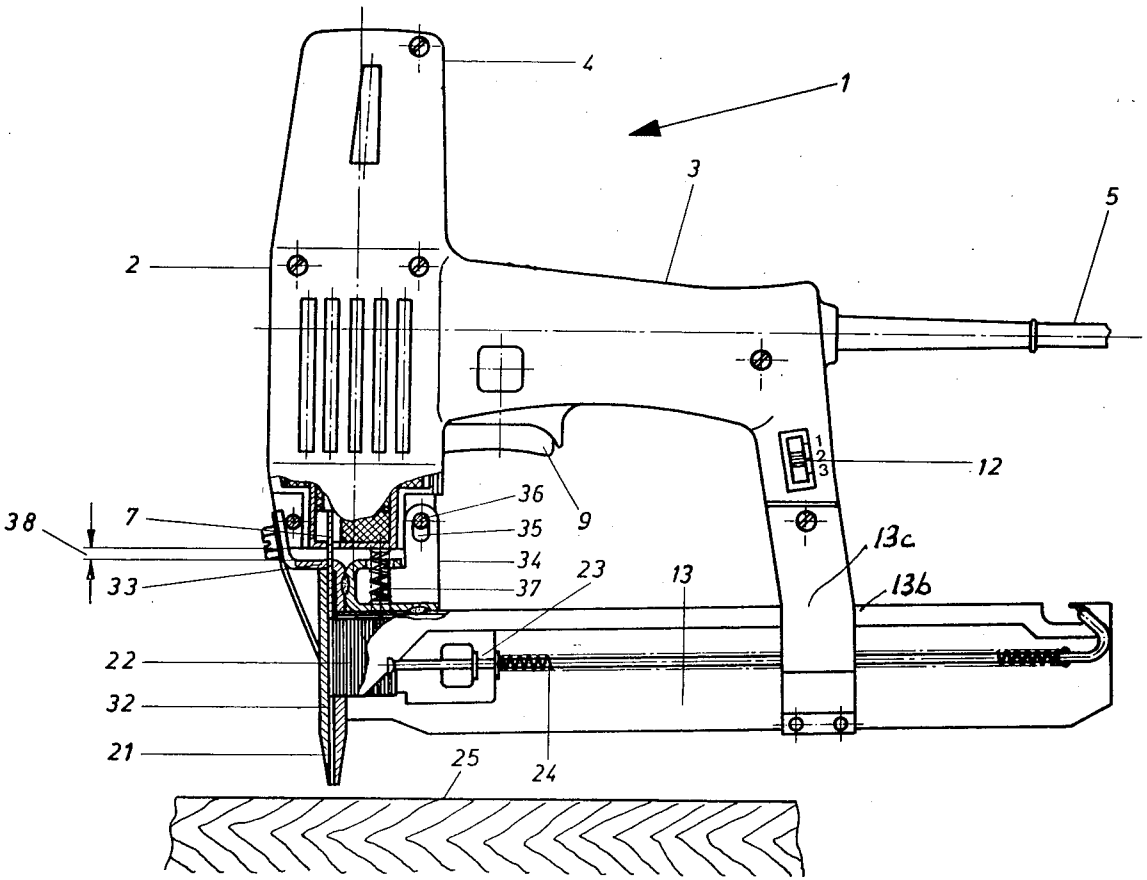
FIG. 1 is a somewhat schematic side elevational view of an apparatus which embodies one form of the invention, a portion of the magazine for fasteners and of the adjacent part of the housing being broken away and the impeller of the apparatus being shown in a starting position in which it allows the foremost fastener of the supply of fasteners in the magazine to enter a channel below the impeller.

The retracted position of the armature 6 during the intervals between successive energizations of the winding 10 is preferably selected in such a way that the lowermost portion of the blade 7 comes to rest in the position which is shown in FIG. 4, namely, in a position in which the blade extends into the channel 21 through a distance (38) sufficient to ensure that the foremost staple of the stack of staples 22 in the magazine 13 is prevented from entering the channel 21 by way of the outlet 13*a*. Thus, the pusher 23 and its spring 24 are unable to introduce the foremost staple 22 of the stack of staples from the magazine 13 into the channel 21 as long as the handle 3 is pressed toward the workpiece 25 in the aforediscussed manner and as shown in FIG. 4. When the spring 37 is free to move the magazine 13 and the channel 21 until the web of the foremost staple 22 in the magazine 13 is located at a level below the edge of the blade 7, the pusher 23 is free to admit a staple 22 into the channel 21 via outlet 13*a* because the spring 24 is then free to expand and to cause the pusher 23 to introduce the foremost staple 22 from the magazine 13 into the channel 21 between the outlet of this channel and the adjacent edge face of the blade 7. This enables the blade 7 to propel the staple 22 in the channel 21 toward and into the workpiece 25 as soon as the electromagnet including the armature 6 and the winding 10 is energized again to move the blade 7 downwardly, as viewed in FIG. 4. The same procedure is repeated whenever the blade 7 is retracted to its raised position upon completion of any of its working strokes, e.g., of the first of two or more strokes. In other words, at such time, the lower edge face of the blade 7 does not rise above the level of the topmost portions of staples 22 in the magazine 13 and the foremost staple 22 cannot leave the magazine to enter into the space behind the staple in the channel 21 and the raised or retracted blade 7. However, when the control system of the apparatus has transmitted a selected number of firing impulses (as selected by the setting of the switch 12), the blade 7 returns to its starting position and, if the spring 37 is allowed to expand, the pusher 23 and its spring 24 are free to introduce the foremost staple 22 from the magazine 13 into the channel 21. At such time, the lower edge face 7 is held in the position which is shown in FIG. 1 (i.e., above the topmost portions of staples 22 in the magazine 13) because the pressure upon the handle 3 is relaxed so that the spring 37 can maintain the magazine 13 and the channel 21 in their inoperative positions. The material of the workpiece 25 can be wood, a synthetic plastic substance, a metal, concrete or any other substance which permits penetration of the tips of the two legs of a U-shaped staple or the leading end or ends of a different fastener to penetrate thereinto.

Figure 12:
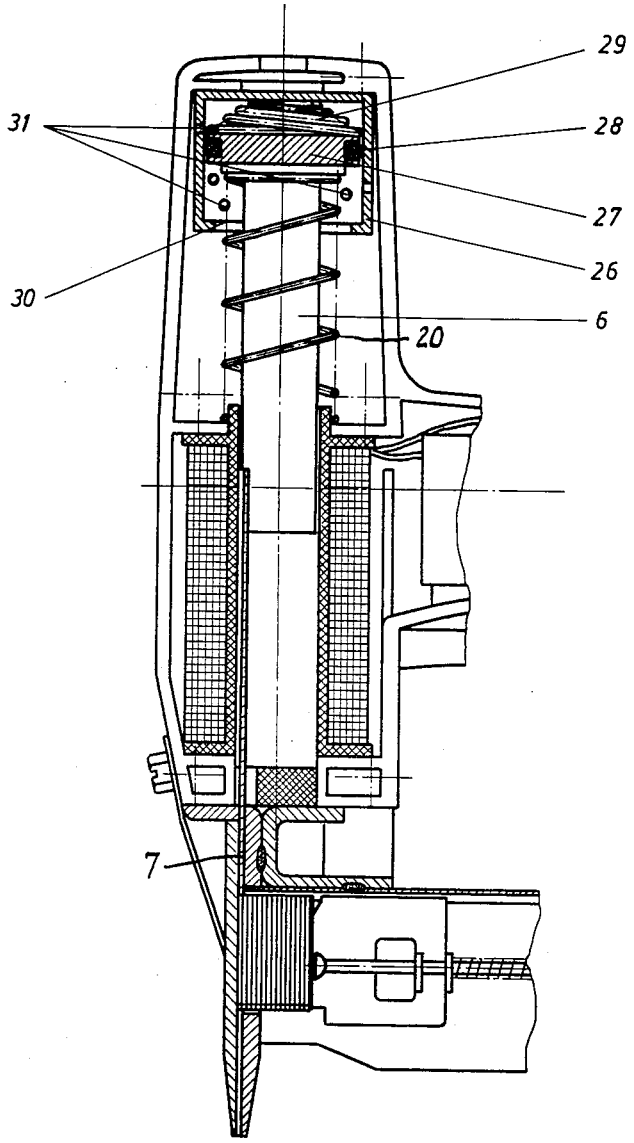
FIG. 12 is a fragmentary partly elevational and partly sectional view of a second apparatus employing a braking device which constitutes a modification of the braking device shown in FIGS. 7 to 10.
Figure 13:
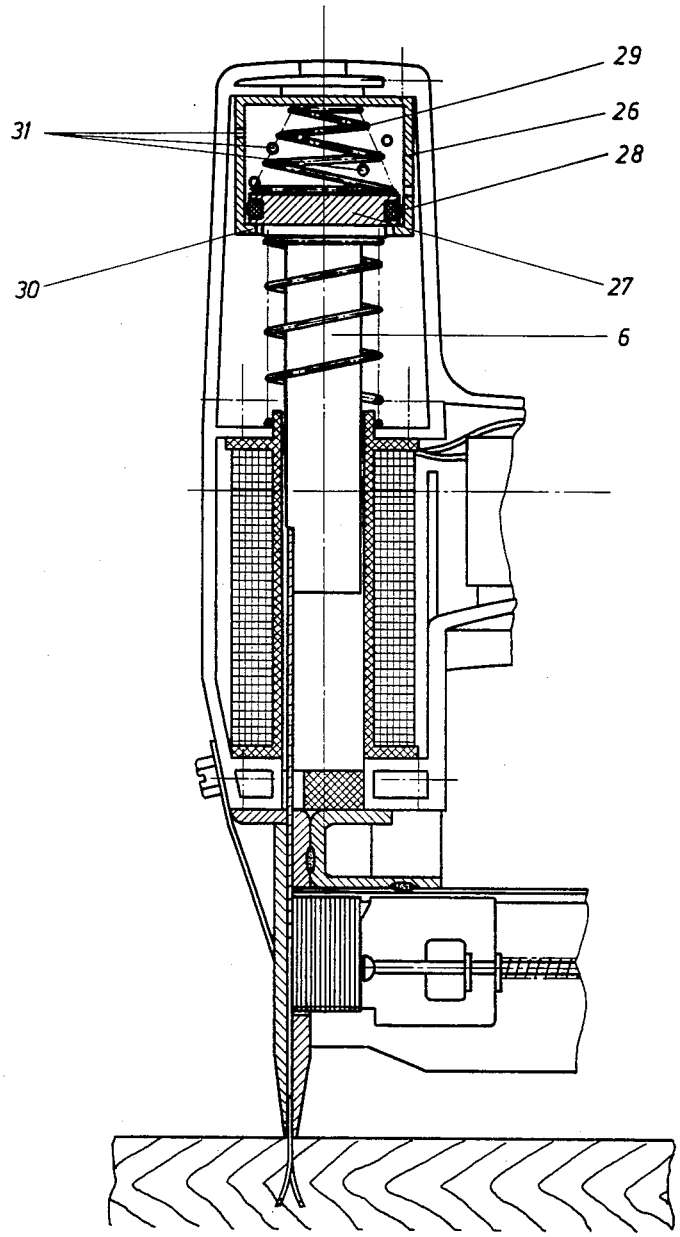
FIG. 13 is a view similar to that of FIG. 12 but showing the armature in a different axial position.

FIGS. 12 and 13 illustrate a different embodiment of the improved apparatus which is designed to greatly reduce friction between the reciprocable armature 6 of the electromagnet and the parts which are adjacent thereto. The spring 20 urges the upper end portion of the armature 6 against a discrete piston 27 which is reciprocable in the casing 26 of a shock absorber and carries a circumferential sealing ring 28. The upper end portion of the armature 6 approaches and engages the piston 27 when the armature approaches its upper end position i.e., when the impeller blade 7 approaches its raised or starting position. The function of aerating openings 31 in the casing 26 is analogous to that of aeratating openings 15 in the cylinder 14*a* of the braking device 14 shown in FIG. 7. The piston 27 is urged downwardly, as viewed in FIGS. 12 and 13, by a conical coil spring 29 which reacts against the underside of the top wall of the casing 26 and bears against the adjacent end face of the piston 27. Such downward movement of the piston 27 takes place whenever the electromagnet including the armature 6 is energized, i.e., whenever the armature 6 performs a downward stroke (as viewed in FIG. 12 or 13). The downward movement of the piston 27 is limited by the bottom end wall 30 of the casing 26; such bottom end wall acts as an abutment or stop which maintains the piston 27 in the lower end position (under the action of the spring 29) and in the path of upward movement of the armature 6.

An advantage of the structure which is shown in FIGS. 12 and 13 is that friction between the armature 6 and the adjacent parts is a small fraction of friction between the armature of FIG. 7 and the parts which are in contact therewith. This will be readily appreciated since the armature 6 of FIG. 7 is provided with a piston which carries the sealing ring 18 and the latter is necessarily in at least some sealing engagement with the internal surface of the cylinder 14*a*. Moreover, the apparatus of FIGS. 12 and 13 is even less affected by the inclination of its housing; for example, the operator can decide to invert the apparatus preparatory to driving staples or other types of fasteners into the underside of a ceiling while standing below the ceiling. The apparatus of FIGS. 12 and 13 also produces a highly satisfactory damping action because the armature 6 must diplace the piston 27 against the opposition of the spring 29 when the armature 6 is moved upwardly by the spring 20, i.e., when the electromagnet including the armature 6 and its winding 10 is deenergized.

Figure 8:
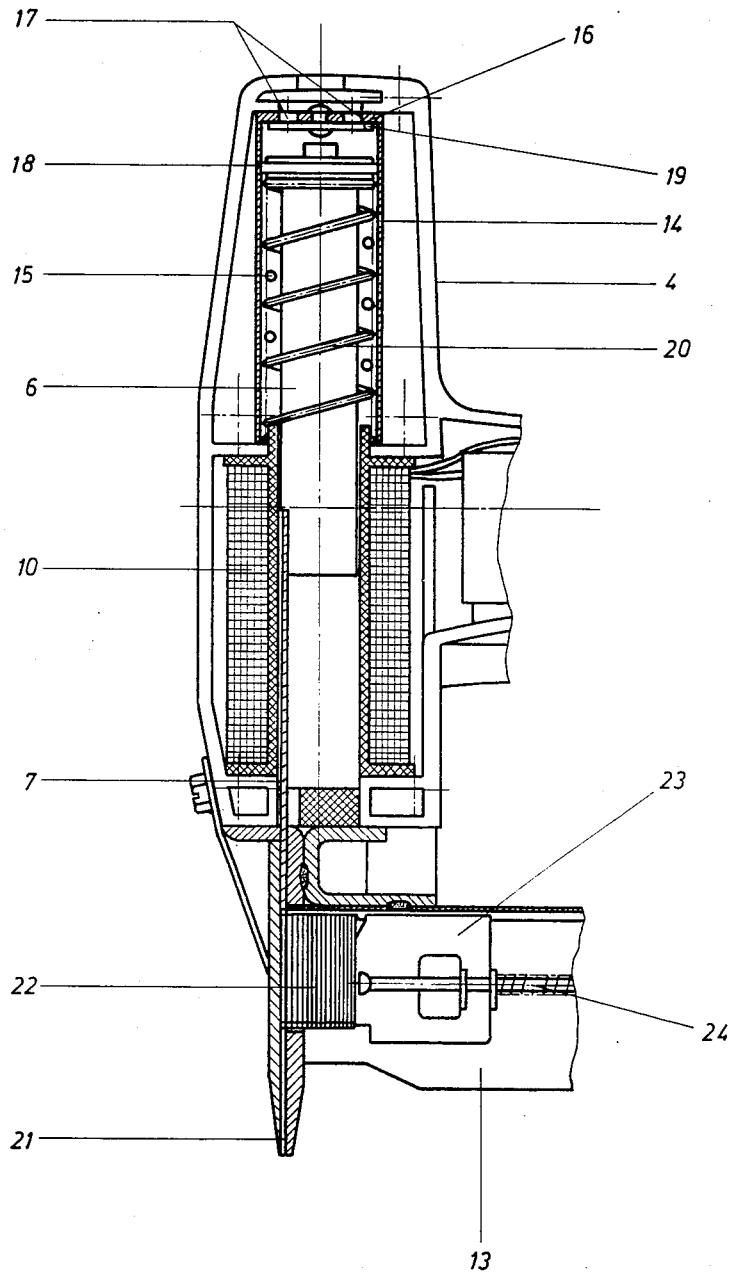
FIG. 8 is an enlarged view of the structure which is shown in the left-hand portion of FIG. 7, the armature of the electromagnet being shown close to its fully retracted position and the impeller being shown at a level above the supply of fasteners in the magazine.

The braking device 14 of FIGS. 7 to 9 or the pneumatic shock absorber of FIGS. 12 and 13 can be used jointly with or in lieu of a simple stop in the form of an abutment which is moved into the path of rearward or upward movement of the armature 6 by a discrete electromagnet or the like. The armature of such electromagnet is shown at 50 in FIG. 9 of the drawing, and a portion of this armature constitutes the stop. The electromagnet including the armature 50 can be energized in automatic response to predetermined rearward movement of the armature 6, i.e., when the armature 6 reaches a position at a certain distance from the workpiece.

FIG. 11 is a developed view of the cylinder 14 and shows the distribution of aerating openings 15. It will be noted that the number of such aerating openings decreases in a direction from the lower end portion toward the upper end portion of the cylinder 14*a*, i.e., the cylinder portion 14*a'* which is nearest to the top wall 16 has no openings at all and the combined cross-sectional area of openings 15 in the cylinder portion therebelow is less than the combined cross-sectional area of openings 15 further down. This ensures gradual braking of the armature 6 as the latter moves away from the workpiece and complete stoppage of the armature in a predetermined position of the blade 7, namely, in a position in which the blade obstructs the outlet 13*a* of the magazine 13 during each interval between successive energizations of the winding 10.

The distribution of aerating openings 31 in the casing 26 of the shock absorber shown in FIGS. 12 and 13 is preferably similar to that of the openings 15 in the cylinder 14*a*.

In each embodiment of the improved apparatus, the winding 10 of the electromagnet is energized during a portion of a single cycle or during certain portions of two or more successive cycles (particularly by one of more half waves of a-c current), and the return stroke or strokes of the armature 6 of the electromagnet (while the winding 10 is deenergized between two or more successive energizations) are selected in such a way that the impeller 7 cannot permit the introduction of a fresh staple 22 into the channel 21 before the last deenergization of the winding 10. In other words, if the winding 10 is to be energized twice, the impeller 7 is retracted to its starting position after the first deenergization and again after the second deenergization but a fresh staple 22 cannot leave the magazine 13 during the interval which elapses between the first and second energizations of the winding 10. Such foremost staple 22 is permitted to enter the channel 21 upon completion of the second energization of the winding 10 and subsequent movement of the magazine 13 away from the workpiece, i.e., upon expansion of the spring 37. The armature 6 does not permit the blade 7 to assume a retracted position in which its leading portion is out of register with the outlet 13*a* for introduction of fresh staples 22 from the magazine 13 into the channel 21 between successive energizations of the winding 10. The switch 12 enables the operator of the apparatus to select the number of successive energizations of the winding 10. As a rule, the number of energizations need not exceed ten and can be much less. It has been found that the circuit 11 of FIG. 14 is quite satisfactory if it enables the operator to select up to eight successive energizations of the electromagnet including the winding 10 and the armature 6. Thus, the operator can select the number of impacts which are to be applied to a staple 22 in the channel 21 before such staple is driven home into the material of the workpiece 25. The number of impacts will depend on the intensity of individual impacts, on the dimensions and configuration of the fasteners and/or on the density of the material of the workpiece. Also, the number of impacts will depend on the direction in which a fastener is to be driven into a workpiece whose resistance to penetration of a foreign object depends on the direction in which the foreign object (such as a staple or a nail) is to penetrate into its material.

Figure 3:
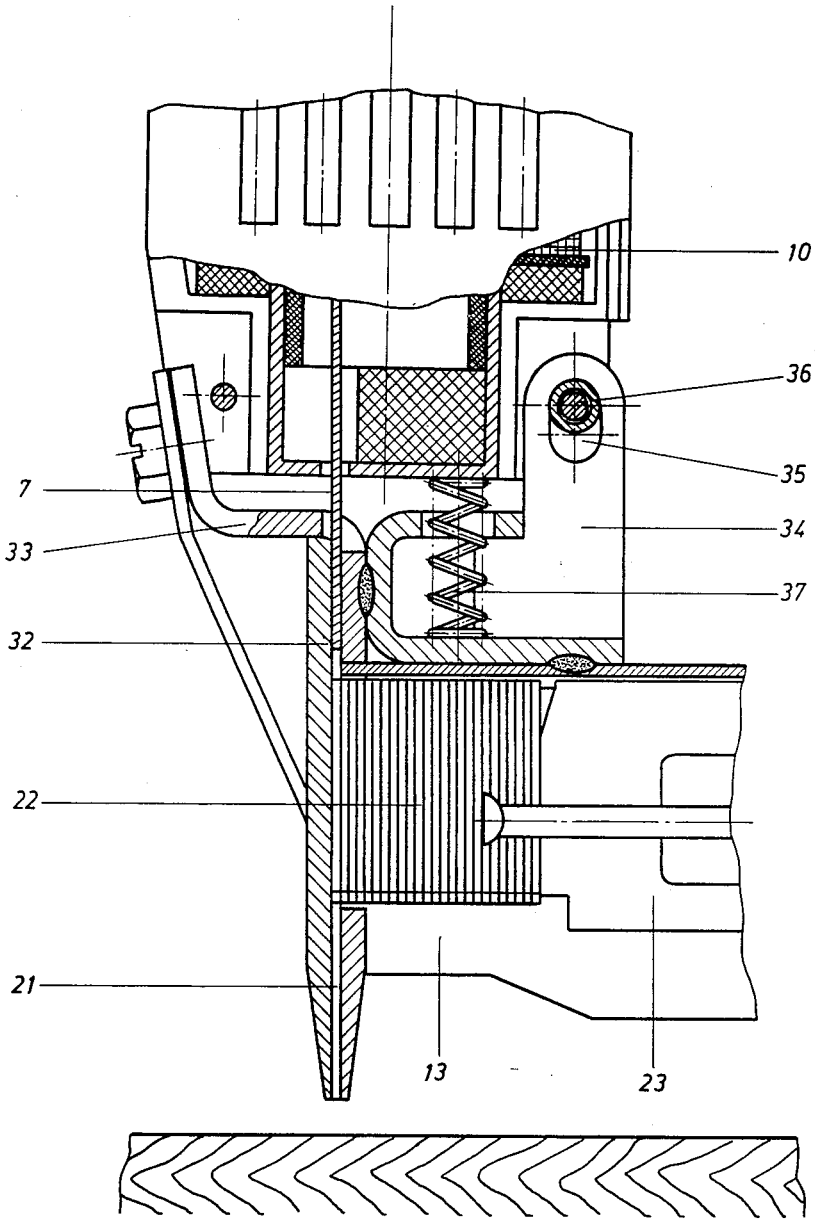
FIG. 3 is a greatly enlarged view of the structure which is shown in the lower portion of FIG. 2.

All components of the control circuit 11 which is shown in FIG. 14 can constitute commercially available elements. All that counts is to ensure that this control circuit is capable of energizing and deenergizing the winding 10 in the aforedescribed manner. Also, the apparatus should prevent the blade 7 from exposing the outlet 13*a* before the last energization of the winding 10 if the winding is to be energized more than once. Thus, the blade 7 can be said to constitute a barrier which automatically and reliably prevents interference with the expulsion of a fastener from the channel 21 into the workpiece by the foremost fastener which is still confined in the magazine 13 or in an analogous magazine. As can be seen in FIG. 4, the apparatus can be designed in such a way that the blade 7 automatically shifts the foremost staple 22 (namely, the staple which can still adhere to the stack of staples in the magazine 13 but is already located in the channel 21) with reference to the neighboring fastener 22 even before the winding 10 of the electromagnet is energized for the first time. This is achieved by shifting the magazine 13 relative to the blade 7 and/or vice versa against the opposition of the spring 37 so that the foremost portion of the blade 7 penetrates into the channel 21 and thereby shifts the staple 22 therein relative to the staples which are located in the magazine 13 to such an extent (see 38 in FIG. 4) that the foremost portion of the blade 7 prevents any expansion of the spring 24 and corresponding forward movement of the pusher 23 until after the magazine 13 is free to follow the bias of the spring 37 and assumes the position which is shown in FIG. 1, 2 or 3.

The magazine 13 which is shown in FIG. 7 is reciprocable along a more or less straight path in substantial parallelism with the path of movement of the armature 6 and impeller 7. A similar result can be achieved if the magazine 13 is pivotally connected to the housing, e.g., by pivotally connecting the housing 2 (at 13*c*) with that end portion (13*b*, see FIG. 1) of the magazine 13 which is remote from the channel 21. The spring 37 then tends to pivot the magazine 13 and the housing part defining the channel 13*a* in a counterclockwise direction, as viewed in FIG. 1.

Figure 6:
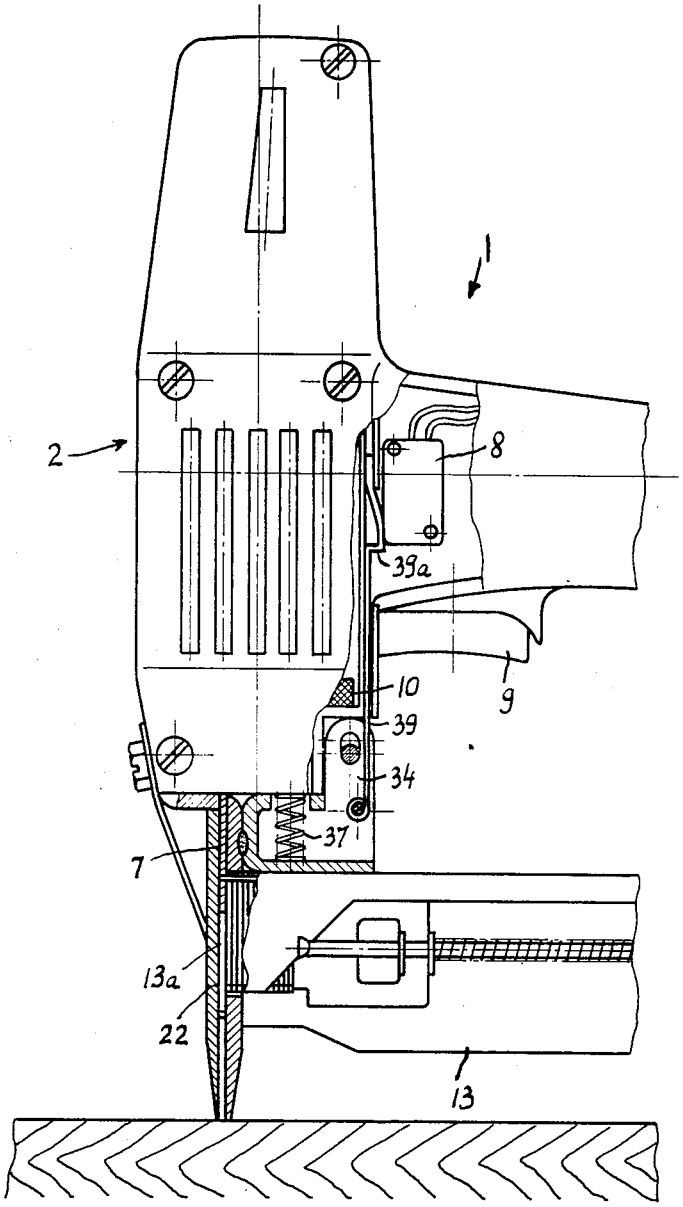
FIG. 6 illustrates the structure of FIG. 2 but with the housing abutting against the workpiece and with the trigger in depressed position.

As can be seen in FIG. 6, movement of the outlet 13*a* of the magazine 13 with reference to the impeller blade 7 so that the blade separates the foremost staple 22 of the stack of staples in the magazine from the neighboring staple can automatically result in closing of the switch 8 by the trip 39*a* of the release lever 39 so that the control circuit 11 is ready to initiate the first of several energizations of the winding 10 as soon as the trigger 9 is depressed. The impeller 7 blocks the outlet 13*a* during the entire interval which elapses between the movement of the housing 2 relative to the magazine 13 against the opposition of the spring 37 (i.e., between the movement of the follower plate 34 from the position of FIG. 1 to the position of FIG. 4) and the completion of last energization of the winding 10. The provision of a trigger 9 in addition to the switch 8 ensures that the first energization of the winding 10 takes place only when the operator holding the apparatus in the position of FIG. 4 is ready.

The apparatus 1 exhibits the advantage that its energy requirements are much lower than those of conventional apparatus which must enable the impeller to propel a fastener into a workpiece in response to a single energization of the electromagnet. In the improved apparatus, the force which is required to drive a fastener home can be the sum of several consecutively applied smaller forces, i.e, to the sum of forces which are applied by the armature 6 in response to two or more successive energizations of the winding 10. Moreover, the apparatus can be used to drive home relatively long fasteners which are not readily introduced into a workpiece in response to the application of a single impact. The apparatus can receive energy from a standard outlet, and the mechanical stressing of its constituents is a small fraction of stresses to which the constituents of a conventional apparatus are subjected as a result of the application of a impact of pronounced or highly pronounced intensity. The energy can be supplied by a simple cable so that energy losses due to the use of heavy-duty cables are avoided. Still further, the reaction forces which develop in response to each energization of the winding 10 are relatively small. The intervals between successive energizations of the winding 10 are normally of identical duration, and each such energization is normally caused by a single half-wave during each cycle.

The aforediscussed braking means 14 and 26–30 and the mechanical arresting means 50 for the armature 6 and impeller 7 constitute but a few examples of means for effecting timely stoppage of the impeller 7 during the intervals between successive energizations of the winding 10 in such a way that the impeller blocks the outlet 13*a* of the magazine 13. Also, the illustrated magazine can be replaced by any other suitable magazine which is designed to store a series of nails, staples or other types of fasteners and has an outlet for admission of successive fasteners into the path of forward movement of the impeller. The configuration of the impeller depends on the shape and/or size of the fasteners.

The magnitude of the force of the spring 37 is in a predetermined relation to the impacts which are transmitted to the impeller 7 in response to each energization of the winding 10.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for driving nails, staples or analogous fasteners into workpieces, comprising a housing defining a path along which successive individual fasteners can be advanced in a predetermined direction to penetrate into a selected workpiece; a magazine arranged to store a series of coherent but separable fasteners and having outlet means communicating with said path; means for urging successive fasteners of the series through said outlet means and into said path; a reciprocable impeller disposed in said path and normally assuming a predetermined starting position behind said outlet means, as considered in said direction; propelling means actuatable to propel the impeller in said direction with reference to said outlet means so that a fastener in said path is advanced toward a workpiece which is disposed in front of the path in response to each actuation of the propelling means, the outlet means of said magazine being movable with reference to said impeller; means for opposing movement of said outlet means from a first position in which the foremost fastener of the series is free to enter said path in the starting position of said impeller to a second position and to thereby move the fastener in said path against the impeller while the impeller assumes its starting position so that the impeller effects separation of the fastener in said path from the neighboring fastener of the series; and means for moving the impeller counter to said direction and back to said starting position through distances such that the impeller blocks the outlet means and thus prevents a fresh fastener from advancing from the magazine into said path prior to expulsion of the preceding fastener from said path.

2. The apparatus of claim 1, wherein said moving means comprises means for accelerating said impeller counter to said direction and means for braking the thus accelerated impeller to bring the impeller to a halt before it exposes said outlet means.

3. The apparatus of claim 2, wherein said braking means comprises a pneumatic braking device.

4. The apparatus of claim 3, wherein said propelling means includes an electromagnet including a reciprocable armature which is connected with said impeller, said braking device comprising a cylinder, a piston provided on said armature and reciprocable in said cylinder, and a check valve arranged to open in response to movement of said piston in said cylinder on energization of said electromagnet.

5. The apparatus of claim 4, wherein said cylinder has at least one air-admitting port and said check valve comprises an elastic valving element arranged to seal said port when said armature moves the piston counter to said direction and to expose said port for admission of air into said cylinder when the piston moves in said direction to thereby reduce the pressure in said cylinder.

6. The apparatus of claim 4, wherein said cylinder has aerating openings arranged to permit escape of air from its interior in response to movement of said piston counter to said direction.

7. The apparatus of claim 6, wherein the combined cross-sectional area of said openings decreases in successive portions of said cylinder, as considered counter to said direction.

8. The apparatus of claim 2, wherein said braking means comprises a shock absorber.

9. The apparatus of claim 1, wherein said propelling means comprises an electromagnet which is operatively connected with said impeller and is energizable at predetermined intervals, and further comprising control means for selecting the number of successive energizations of the electromagnet.

10. The apparatus of claim 9, wherein said control means includes an electronic circuit having means for selecting up to at least eight successive energizations of the electromagnet.

11. The apparatus of claim 1, wherein said moving means comprises means for accelerating said impeller counter to said direction and further comprising means for arresting the accelerated impeller at a predetermined distance from said outlet means.

12. The apparatus of claim 11, wherein said arresting means comprises an abutment movable into and from the path of movement of said impeller counter to said direction.

13. The apparatus of claim 1, wherein said magazine has a portion which is remote from said outlet means and further comprising means for pivotally mounting said portion of the magazine on said housing.

14. The apparatus of claim 1, wherein said magazine is movable with reference to the impeller in substantial parallelism with the direction of movement of fasteners along said path.

15. The apparatus of claim 1, wherein said opposing means comprises at least one resilient element arranged to apply to said magazine a force which is a predetermined fraction of the force which moves the impeller in said direction in response to energization of the electromagnet.

16. The apparatus of claim 1, wherein said propelling means comprises an electromagnet and further comprising means for energizing said electromagnet in response to movement of the outlet means to said second position.

17. The apparatus of claim 4, wherein said propelling means includes an electromagnet which comprises a reciprocable armature connected to said impeller and a winding which is energizable to move said armature and said impeller counter to said direction, and further comprising means for energizing the winding a selected number of times including a pair of synchronized decimal counters having outlets arranged to furnish energizing impulses to said winding, means for selecting the number of energizing impulses, a flip-flop circuit connected with said outlets and an output thyristor interposed between said circuit and said winding.

18. The apparatus of claim 1, wherein the outlet means of said magazine is arrange to move with reference to said impeller in response to engagement of said housing with a workpiece to thereby effect automatic separation of the foremost fastener in said magazine prior to actuation of said propelling means.

* * * * *